United States Patent [19]

Wilbur, Jr. et al.

[11] Patent Number: 4,604,967

[45] Date of Patent: Aug. 12, 1986

[54] SYSTEM FOR UNIFORMLY DISPENSING A PASTE MATERIAL TO A SEAL EDGE

[75] Inventors: Leonard P. Wilbur, Jr.; Wallace B. Anthony, both of Lancaster, Pa.

[73] Assignee: RCA Corporation, Princeton, N.J.

[21] Appl. No.: 654,485

[22] Filed: Sep. 26, 1984

[51] Int. Cl.[4] ..... B05C 5/02

[52] U.S. Cl. ..... 118/668; 118/696; 118/698; 118/409

[58] Field of Search ..... 118/696, 668, 320, 321, 118/409, 698

[56] References Cited

U.S. PATENT DOCUMENTS 3,492,146 1/1970 Kornaker ..... 117/43

4,137,341 1/1979 Adachi ..... 427/64

4,458,628 7/1984 Fujii et al. ..... 118/321 X

*Primary Examiner*—John P. McIntosh

*Attorney, Agent, or Firm*—E. M. Whitacre; D. H. Irlbeck; L. L. Hallacher

[57] ABSTRACT

A system for uniformly dispensing a frit material onto the seal edge of a CRT funnel includes a motor for rotating the funnel. The motor also drives a pulse generator which provides a selected number of input pulses for each increment of rotation. The input pulses are provided to two programmable BCD counters. One counter controls the funnel motor and is programmed to change the motor speed around the funnel corners. The other counter controls the feed screw dispenser and is programmed to maintain the ratio of motor speeds within a selected range of values.

5 Claims, 2 Drawing Figures

SYSTEM FOR UNIFORMLY DISPENSING A PASTE MATERIAL TO A SEAL EDGE

BACKGROUND

This invention relates generally to the production of cathode ray tubes (CRT) and particularly to a system for uniformly dispensing frit material to the seal edge of the funnel portion of such CRTs.

A CRT envelope is composed of a faceplate panel, a funnel and a neck. A phosphor screen is provided on the inside surface of the faceplate panel and luminesces when impacted by electrons to provide a visual output. The neck supports an electron gun which provides the electrons to scan the phosphor screen. The funnel and panel must be permanently and hermetically joined to permit evacuation of the envelope as required for operation of the CRT. The panel and funnel are each provided with mating seal edges along which they are joined. A vitrifiable material is placed continuously along one of the seal edges. The funnel is placed in a carrier and the panel is placed on the funnel with the mating seal edges aligned. The carrier supports the funnel and panel as they pass through an oven which is raised to high temperature to vitrify the frit material to permanently and hermetically join the two components.

Typically, the frit material is applied to the sealing edge of the funnel by rotating the funnel at a constant speed. A frit material dispense is pivotably arranged above the seal edge whereby the dispenser remains a constant distance from the funnel as the funnel rotates. The frit material is dispensed onto the seal edge by rotating a feed screw within the dispenser. The configuration of the seal edge is substantially rectangular with rounded corners and slightly curved sides. Accordingly as the funnel rotates, the peripheral velocity with respect to the dispenser changes as the distance of the dispenser from the rotational axis of the funnel changes. The frit material, therefore, is nonuniformly dispensed onto the seal edge unless the ratio of the rotational velocities of the funnel and of the feed screw is held constant.

For this reason, there is a need for a system for maintaining the ratio of the rotational speeds of the funnel and feed screw constant within a range of values to assure the uniform dispensation of the frit material onto the seal edge. The present invention provides such a system.

CROSS REFERENCE TO RELATED APPLICATION

The present invention can be used with the invenion described in Application Ser. No. 654,486 entitled "PASTE MATERIAL DISPENSING DEVICE" filed on even date herewith by Leonard P. Wilbur, Jr.

SUMMARY

A system, for uniformly dispensing a paste material to the edge of a rotating, rounded corner, substantially rectangular object, from a dispensing apparatus having a feed screw, includes first means for rotating the object. A pulse generator means is responsive to the first means for rotating and provides a preselected number of input pulses for each increment of rotation of the object. A second means rotates the feed screw. First pulse counter means, which receives the input pulses and provides a plurality of first output pulses is responsive to the first output pulses whereby the speed of rotation of the first means for rotating is proportional to the first output pulses. Second pulse counter means, which receives the input pulses and provides a plurality of second output pulses is responsive to the second output pulses whereby the speed of rotation of the second means for rotating is proportional to the second output pulses.

DETAILED DESCRIPTION OF THE PREFERRED EMBODIMENT

Figure 1:
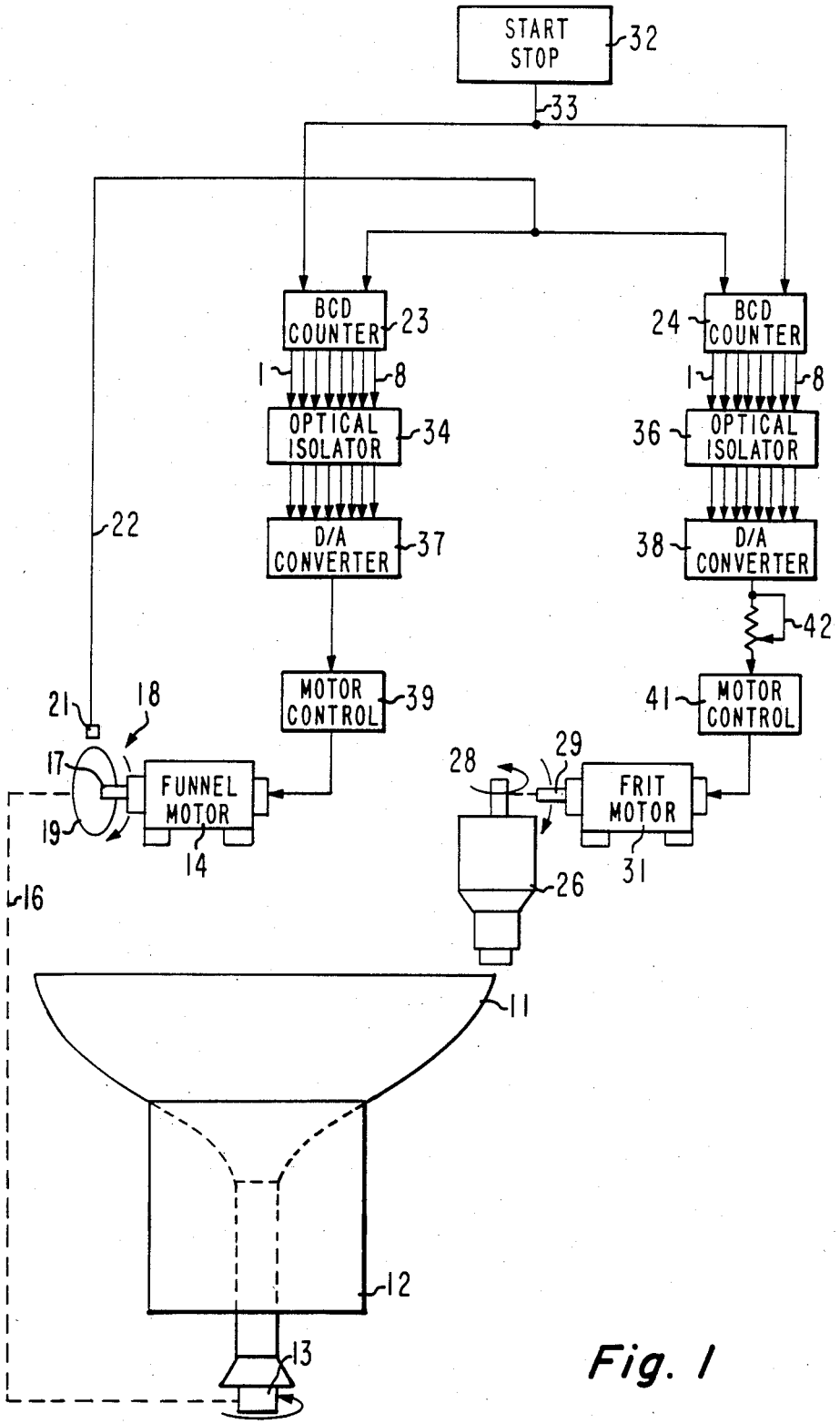
FIG. 1 is a block diagram of a preferred embodiment of the present invention.

In FIG. 1, the funnel 11 of a CRT is supported by a support member 12 having a shaft 13. The shaft 13 is coupled to a shaft 17 of a funnel motor 14 by an appropriate mechanical coupling 16. A pulse generator 18 also is coupled to the shaft 17 of the motor 14. The pulse generator 18 can be in the form of a disc having 360 equally spaced teeth and a sensor 21 which yields an output pulse each time a tooth passes the sensor. Accordingly, one complete revolution of the shaft 17 results in the provision of 360 output pulses. These 360 pulses also can represent one complete revolution of the funnel 11 of the CRT. The pulses are provided by the line 22 to serve as input pulses to two similar Binary Coded Decimal (BCD) counters 23 and 24.

Figure 2:
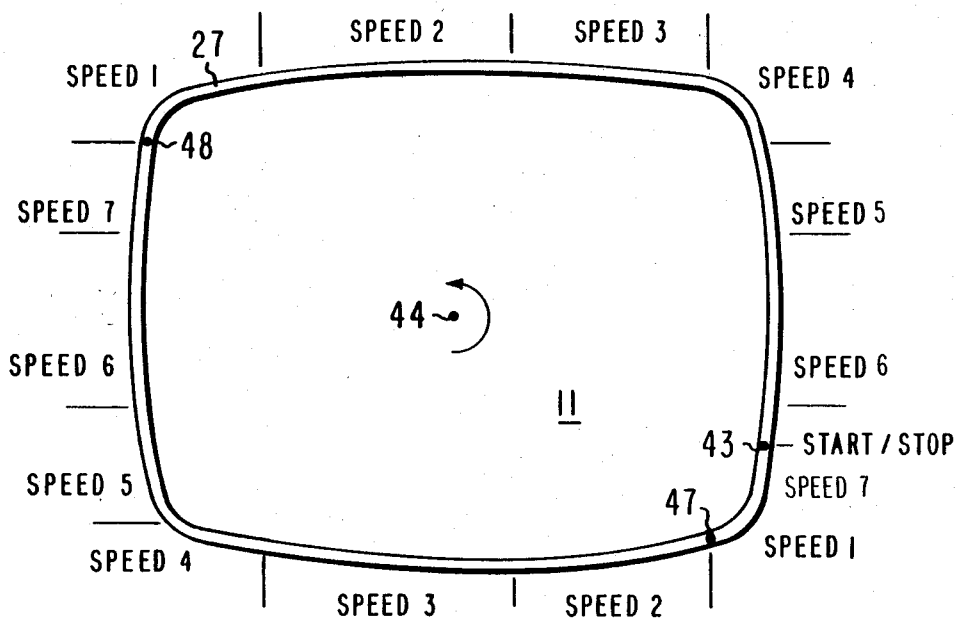
FIG. 2 shows how the rotational speed of the funnel is varied as the frit dispenser moves around the seal edge of the funnel.

A frit dispenser 26 is permanently positioned above the seal edge 27 (FIG. 2). A feed screw 28 is mechanically coupled to a shaft 29 of a frit dispense motor 31. As explained in Copending Application Ser. No. 654,486 fully reference hereinabove, the frit dispenser 26 follows along the seal edge 27 of the funnel 11 as the funnel is rotated by the funnel motor 14. The frit material is fed by the rotation of the feed screw 28 which is rotated by the frit motor 31.

The BCD counters 23 and 24 are actuated by a start/stop device 32 over a line 33. The start/stop device 32 can be appropriately located proximity switches, or in the alternative, can be a programmable device, such as a MICRO 84 Model No. Modicon supplied by Gould. The BCD counterss 23 and 24 each have eight output lines numbered 1 to 8. The counters 23 and 24 can be, for example, Durant system 6450 programmable counters available from Eaton Corporation. As explained hereinafter which respect to Tables I and II, the BCD counters 23 and 24 are programmable so that selected combinaions of the output lines 1 to 8 are high for preselected numbers of input pulses from the pulse generator 18. The speeds of the motors 14 and 31 are dependent upon the combinations of high output lines of the counters 23 and 24, respectively. Accordingly, the ratio of the motor speeds can be maintained constant within a range of values by programming the BCD counters 23 and 24.

The output lines 1 to 8 of the BCD coungers 23 and 24, respectively are coupled as input lines to commercially available optical isolators 34 and 36, respectively. The optical isolators 24 and 36 provide electrical isolation between the various portions of the system. The output of the optical isolator 34 is used to control the speed of the funnel motor 14 through a digital-to-analog (D/A) converter 37 and a motor control 39. Similarly, the output of the optical isolator 36 controls the speed of the first motor 31 through a D/A converter 38 and a motor control 41. However, a potentiometer 42 is arranged between the D/A converter 38 and the motor control 41 to provide additional control of the speed of the frit motor 31.

The speed of the funnel motor 14 is dependent upon the output voltage provided by the D/A converter 37 to the motor control 39. For example, when the output of the D/A converter 37 is at a maximum, for example 10 volts, the funnel motor 14 runs at full speed, for example 1700 rpm. When the output voltage of the D/A converter 37 is decreased by a particular percentage, the rotational speed of the funnel motor 14 also decreases by that same particular percentage. These percentage changes are controlled by selecting the number and combination of high output leads 1 to 8 of the BCD counter 23. The speed of the frit motor 31 is controlled by the BCD counter 24 in the same manner that the funnel motor 14 is controlled by the BCD counter 23. However, the presence of the potentiometer 42 provides additional control of the drive voltage, and thus of the motor speed, and the ratio of rotational speeds of the funnel motor 14 and frit motor 31 can be accurately held constant within a narrow range of values.

FIG. 2 shows how the linear speed of the seal edge 27 changes as the seal edge 27 passes beneath the dispenser 26. As explained in the copending application fully referenced hereinabove, the dispensation of the frit material onto the seal edge 27 always begins at substantially the same location 43 on the seal edge. The linear velocity V of a rotating body is defined as $V=r\omega$ where: r is the distance from the axis of rotation and $\omega$ is the rotational velocity, in radians. Accordingly, the peripheral velocity of the seal edge 27 in the vicinity of the corner 46, and other corners, is near maximum because the corners are the furthermost distance from the axis of rotation 44 of the seal edge. After the corner 46 of tfhe seal edge 27 passes the frit dispenser 26, the peripheral velocity decreases as the seal edge comes closer to the rotational axis 44. Accordingly, when the rotational velocities of the motors 14 and 31 are held constant, the rate of application of frit material to the seal edge varies along with the change in distance between the dispenser 26 and the axis 44. The frit material is more heavily applied to the portion of the seal edge which are closest to the axis 44 and less heavily applied to those portions of the seal edge which are furthermost from the axis 44. Accordingly, the uniformity of the dispensation of the frit material onto the seal edge 27 can be greatly improved by maintaining the ratio of the speed $V_d$ of the dispenser to the speed $V_f$ of the frit motor within a relatively narrow range of values, such as 1.10 to 1.25.

Table I shows how the BCD counter output lines determine the speed of the funnel motor 14 and frit motor 31. In Table I, when the output line number 1 of the BCD counter is high and the other output leads are low, the associated motor will run at 50 percent of full speed. Each of the succeeding output lines 2–8 result in the associated motor running at one-half the speed of the previous output line. For example, when line 1 is high and all other output lines are low, the associated motor will run at 50 percent speed. When only output line 3 is high, the motor will run at 12.5 percent of full speed. Therefore, when lines 1 and 3 are high and all other lines are low, the associated motor will run at 62.5 percent of full speed.

TABLE I

| BCD COUNTER OUTPUT LINE | % of MAXIMUM MOTOR SPEED |
|---|---|
| 1 | 50 |
| 2 | 25 |
| 3 | 12.5 |
| 4 | 6.25 |
| 5 | 3.125 |
| 6 | 1.56 |
| 7 | 0.78 |
| 8 | 0.39 |

FIG. 2 shows how the seal edge 27 is divided into a pattern of speed zones. The pattern starts at the start/-stop position 43 and continues through speed zones 1 through 7 ending at the end of a speed zone 7 as indicated by position 48. The pattern then is repeated through speed zones 1 through 7 with speed zone 7 ending at the start/stop position 43. The position 48 at the end of speed zone 7 is symmetrically equivalent to the start/stop position 43. That is, if the panel 11 is rotated 180° about the rotational axis 44 positions 43 and 48 will have replaced one another. This positioning technique takes advantage of the symmetry of the funnel 11 to simplify the programming process.

TABLE II

| SPEED ZONE | PULSE DURATION | BCD 23 OUTPUT LINES | % of MAXIMUM SPEED $V_f$ | % of MAXIMUM SPEED $V_d$ | BCD 24 OUTPUT LINES |
|---|---|---|---|---|---|
| 1 | 20 | 3,4 | 18.75 | 21.875 | 3,4,5 |
| 2 | 30 | 1,3,4 | 68.75 | 81.25 | 1,2,4 |
| 3 | 30 | 2 | 25. | 31.25 | 2,4 |
| 4 | 20 | 3,4,5 | 21.87 | 26.56 | 2,6 |
| 5 | 30 | 1 | 50. | 59.375 | 1,4,5 |
| 6 | 40 | 1,4,5 | 59.37 | 71.875 | 1,3,4,5 |
| 7 | 10 | 2,3 | 37.5 | 45.31 | 2,3,4,6 |

Table II shows the programming of the BCD counters 23 and 24 for an exemplary frit motor 31 speed $V_d$ to funnel motor 14 speed $V_f$ ratio ($V_d/V_f$) in the range of 1.10 to 1.25. It should be noted that the optimum ratio range is dependent upon the viscosity of the frit material being dispensed from the dispenser 26 (FIG. 1). For this reason, the range of the speed ratio should be optimized as the viscosity of the frit varies from batch to batch. The potentiometer 42 can be used for this purpose. In Table II, speed zone 1 is shown to last for 20 output pulses of the pulse generator 18. The BCD counter 23 is programmed so that output lines 3 and 4 are high and the other output lines are low. As shown in Tables I and II, this results in a speed of the funnel motor 14 of 18.75 percent of the maximum speed of 1700 rpm. The speed $V_d$ of the frit motor 31 then should be 21.875 percent of maximum to maintain a speed ratio within the exemplary 1.10 to 1.24 rane. Accordingly, output lines 3, 4 and 5 of the BCD counter 24 are high, the other output lines are low during the 20 pulse period. Speed zone 2 lasts for 30 pulses and output lines 1, 3 and 4 of BCD counter 23 are high resulting in a 68.5 percent speed of funnel motor 14. The speed of frit motor 31 then is 81.25 percent and output lines 1, 2 and 4 of BCD counter 24 are high during the 30 pulse period. Accordingly, as shown in Table II, the speeds of the motors 14 and 31 are raised and lowered as the distance of the seal edge 27 from the axis 44 changes. The end of speed zone 7 is defined by the generation of 180 pulses by the pulse generator 18 and thus corresponds to one-half a revolution of the funnel 11. The seven speed zones are repeated for the second half of the revolution. The motors 14 and 31 are simultaneously controlled by the same pulse generator, and for this reason the speeds of the two motors are accurately synchronized and the ratio of the speeds is accurately maintained within a desired range and the frit material is uniformly supplied to the seal edge 27. Additionally, because of the potentiometer 42 between the D/A converter 38 and motor control 41 the speed $V_d$ of the frit motor 31 can be further controlled to more accurately maintain the desired range of speeds.

What is claimed is:

1. A system for uniformly dispensing a paste material to the seal edge of a rotating, rounded corner, substantially rectangular object, from a dispensing apparatus having a feed screw, said system comprising:

first means for rotating said object;

pulse generator means responsive to said first means for rotating, said pulse generator means providing a preselected number of input pulses for each increment of rotation of said object;

second means for rotating said feed screw;

first pulse counter means for receiving said input pulses and providing a plurality of first output pulses, said first means for rotating being responsive to said first output pulses whereby the speed of rotation of said first means for rotating is proportional to said first output pulses;

second pulse counter means for receiving said input pulses and providing a plurality of second output pulses, said second means for rotating being responsive to said second output pulses whereby the speed of rotation of said second means for rotating is proportional to said second output pulses.

2. The system of claim 1 wherein said first and second pulse counter means are programmable whereby said first and second output pulses are selectable discrete percentages of said input pulses and the ratio of the speeds of rotation is maintained within a range of values.

3. The system of claim 2 wherein said first and second output pulses are provided in Binary Coded Decimal whereby said first and second counter means each has a plurality of output lines in accordance with the number of bits in said Binary Coded Decimal and said discrete percentages are selected by selecting particular combinations of said output lines.

4. The system of claim 2 further including digital-to-analog converter means for individually converting said first and second output pulses into analog signals.

5. The system of claim 4 further including at least one voltage varying means responsive to at least one of said digital-to-analog converter means for further varying the speed of rotation of at least one of said means for rotating.

* * * * *